US008342880B2

(12) United States Patent
Kato et al.

(10) Patent No.: US 8,342,880 B2
(45) Date of Patent: Jan. 1, 2013

(54) ELECTRICAL CONNECTOR WITH ELASTICALLY HELD TERMINALS

(75) Inventors: Hajime Kato, Makinohara (JP); Tsuyoshi Mizushima, Makinohara (JP); Yoshiaki Ozaki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 209 days.

(21) Appl. No.: 12/920,934

(22) PCT Filed: Mar. 5, 2009

(86) PCT No.: PCT/JP2009/054705

§ 371 (c)(1),
(2), (4) Date: Sep. 3, 2010

(87) PCT Pub. No.: WO2009/110639

PCT Pub. Date: Sep. 11, 2009

(65) Prior Publication Data

US 2011/0014822 A1 Jan. 20, 2011

(30) Foreign Application Priority Data

Mar. 5, 2008 (JP) ..... 2008-054523

(51) Int. Cl.
*H01R 13/648* (2006.01)

(52) U.S. Cl. ..... 439/595; 439/382

(58) Field of Classification Search ..... 439/595, 439/246, 382

See application file for complete search history.

(56) References Cited

U.S. PATENT DOCUMENTS 3,648,213 A 3/1972 Kobler
3,971,613 A 7/1976 Kobler
4,013,331 A 3/1977 Kobler
4,085,989 A * 4/1978 McCardell ..... 439/595
5,197,903 A * 3/1993 Casey et al. ..... 439/564
5,417,587 A * 5/1995 Katsuda et al. ..... 439/559
6,280,208 B1 * 8/2001 Masuda et al. ..... 439/98
6,464,538 B2 * 10/2002 Miyazaki et al. ..... 439/607.44
6,595,789 B2 * 7/2003 Oota et al. ..... 439/98
6,695,632 B2 * 2/2004 Matsumoto et al. ..... 439/246
6,702,612 B2 * 3/2004 Miyazaki et al. ..... 439/559
6,821,160 B2 * 11/2004 Fink et al. ..... 439/701
6,905,375 B2 * 6/2005 Ikeda ..... 439/801
6,921,292 B2 * 7/2005 Miyazaki ..... 439/564
6,991,493 B2 * 1/2006 Matsui et al. ..... 439/579

(Continued)

FOREIGN PATENT DOCUMENTS

EP 2019457 A 1/2009

(Continued)

OTHER PUBLICATIONS

International Search Report (PCT/ISA/210) issued in PCT/JP2009/054705, dated Sep. 8, 2009.

*Primary Examiner* — Neil Abrams
(74) *Attorney, Agent, or Firm* — Sughrue Mion, PLLC

(57) ABSTRACT

A connector includes a terminal electrically connected to an end of an electric wire, and a connector housing which accommodates the terminal and the electric wire. The terminal is capable of being fastened to an opposite member by means of a fastening member so that the terminal is electrically connected to the opposite member. The connector housing includes a housing arm which supports the terminal so as to be displaceable in a direction in which the fastening member is fastened to the opposite member.

3 Claims, 13 Drawing Sheets

U.S. PATENT DOCUMENTS

| | | | | |
|---|---|---|---|---|
| 7,041,907 | B2 * | 5/2006 | Miyazaki | 174/72 A |
| 7,059,918 | B2 * | 6/2006 | Matsumoto et al. | 439/752 |
| 7,070,449 | B2 * | 7/2006 | Miyazaki | 439/587 |
| 7,077,676 | B2 * | 7/2006 | Matsumoto et al. | 439/271 |
| 7,094,098 | B2 * | 8/2006 | Miyazaki | 439/559 |
| 7,094,970 | B2 * | 8/2006 | Kihira | 174/74 R |
| 7,101,217 | B2 * | 9/2006 | Hayashi | 439/447 |
| 7,150,631 | B2 * | 12/2006 | Reed et al. | 439/34 |
| 7,165,995 | B2 * | 1/2007 | Fukushima et al. | 439/607.58 |
| 7,264,506 | B2 * | 9/2007 | Mori et al. | 439/606 |
| 7,393,218 | B1 * | 7/2008 | Pavlovic et al. | 439/97 |
| 7,572,150 | B2 * | 8/2009 | Matsuoka | 439/626 |
| 7,597,580 | B1 * | 10/2009 | Advey et al. | 439/383 |
| 7,597,589 | B2 * | 10/2009 | Kawamura | 439/595 |
| 7,614,910 | B2 * | 11/2009 | Croteau et al. | 439/573 |
| 7,811,116 | B2 * | 10/2010 | Sakakura et al. | 439/364 |
| 7,828,591 | B2 * | 11/2010 | Matsuoka | 439/559 |
| 7,959,468 | B2 * | 6/2011 | Yong et al. | 439/607.41 |
| 7,959,469 | B2 * | 6/2011 | Kawamura et al. | 439/607.55 |
| 7,959,470 | B1 * | 6/2011 | Umetsu et al. | 439/626 |
| 7,988,475 | B2 * | 8/2011 | Sakakura | 439/271 |
| 8,152,574 | B2 * | 4/2012 | Matsuoka et al. | 439/801 |
| 8,167,653 | B2 * | 5/2012 | Hasegawa et al. | 439/607.41 |
| 8,177,584 | B2 * | 5/2012 | Matsuoka | 439/587 |
| 2004/0106325 | A1 | 6/2004 | Miyazaki | |
| 2009/0029594 | A1 | 1/2009 | Matsuoka | |
| 2010/0261363 | A1 * | 10/2010 | Sakakura | 439/271 |
| 2011/0014822 | A1 * | 1/2011 | Kato et al. | 439/733.1 |
| 2011/0117784 | A1 * | 5/2011 | Matsuoka et al. | 439/626 |

FOREIGN PATENT DOCUMENTS

| | | | |
|---|---|---|---|
| FR | 1533862 | A | 7/1968 |
| JP | 2000-048912 | A | 2/2000 |
| JP | 2006-031962 | A | 2/2006 |
| JP | 2007-258105 | A | 10/2007 |

* cited by examiner

ELECTRICAL CONNECTOR WITH ELASTICALLY HELD TERMINALS

TECHNICAL FIELD

The present invention relates to a connector used to electrically connect a wire harness to an electric component such as a motor which is mounted to a hybrid automobile or an electric automobile.

BACKGROUND ART

As an example of a related connector, as shown in FIG. 13, there is known a connector 50 including a movable-side connector housing 51 which accommodates a feeding-side terminal 52 and a receiving-side connector housing 53 which accommodates a nut 54 (for example, see Patent Document 1).

In the connector 50 disclosed in Patent Document 1 when the receiving-side connector housing 53 is inserted into a perforation hole 56 of a motor case 55, the nut 54 is disposed so as to have a gap with respect to a motor-side terminal 57.

Subsequently, when the movable-side connector housing 51 is inserted into the receiving-side connector housing 53 from the upside of the motor case 55, the feeding-side terminal 52 enters the gap between the nut 54 and the motor-side terminal 57.

Subsequently, when a bolt 58 is threaded into the nut 54, the motor-side terminal 57 and the feeding-side terminal 52 are electrically connected to each other.

Patent Document 1: JP-A-2007-258105 (FIG. 1)

DISCLOSURE OF INVENTION

Technical Problem

In the connector 50 disclosed in Patent Document 1, at the time when the bolt 58 is threaded into the nut 54, the gap between the motor-side terminal 57 and the feeding-side terminal 52 is filled by the bent feeding-side terminal 52 in accordance with the threading operation of the bolt 58.

In such a configuration, since the area from a position where the feeding-side terminal 52 is integrally formed with the connector housing 51 to a position of the bolt insertion hole is not supported at all, the feeding-side terminal 52 may be bent by an external force before a fastening operation. In addition, for example, when the front end of the feeding-side terminal 52 is bent to the left of FIG. 13, since a gap with respect to the fastening surface of the nut 54 becomes large, it takes trouble to carry out an assembling operation. Alternatively, when the front end is bent to the right of FIG. 13, since a colliding action occurs in a circumferential surface of the nut 54, it is not possible to carry out an accurate positioning operation.

The present invention is contrived in consideration of the above-described problems, and an object of the invention is to provide a connector in which a deformation of a terminal does not occur and a positioning operation of a terminal can be easily carried out to thereby improve reliability of an electric connection operation to an opposite member.

Technical Solution

The above-described object of the invention is achieved by the following configuration.

(1) There is provided a connector comprising:

a terminal electrically connected to an end of an electric wire; and a connector housing which accommodates the terminal and the electric wire, wherein the terminal is capable of being fastened to an opposite member by means of a fastening member so that the terminal is electrically connected to the opposite member; and wherein the connector housing includes a housing arm which supports the terminal so as to be displaceable in a direction in which the fastening member is fastened to the opposite member.

(2) There is provided the connector according to (1), wherein the connector housing further includes a housing lance which locks the terminal so as to prevent the terminal from coming off from the connector housing.

(3) There is provided the connector according to (2), wherein the housing lance positions the terminal in a direction in which the terminal extends.

(4) There is provided the connector according to any one of (1) to (3), wherein the housing arm elastically presses and supports both sides of the terminal in a thickness direction of the terminal.

According to the configuration (1), since the terminal is supported by the housing arm so as to be displaceable, a deformation of the terminal does not occur. According to the connector, the terminal is pressed by the housing arm so that the posture of the terminal is maintained to be parallel in the inside of the connector housing. In addition, at the time when the terminal is electrically connected to the opposite member by means of the fastening member, since the housing arm positions the terminal and the terminal moves in a following manner in accordance with the position of the opposite member, a clattering action of the terminal with respect to the opposite member is absorbed. Accordingly, since the terminal is positioned by the housing arm without a problem that the opposite member is excessively distanced from the terminal in a fastening direction of the fastening member or the opposite member overlaps with the terminal, the terminal can closely contact with the opposite member without applying an excessive stress to the terminal. As a result, it is possible to reliably carry out an electric connection operation to the opposite member, and thus to improve the reliability of an electric connection operation.

According to the configuration (2), since the housing lance locks the terminal, it is possible to hold the terminal in the inside of the housing in a stable manner.

According to the configuration (3), in addition to the configuration in which the housing arm supports the terminal so as to be displaceable in a fastening direction of the fastening member, the housing lance positions and locks the terminal in an extension direction of the terminal. Accordingly, it is possible to position the terminal to a predetermined position inside the connector housing. In addition, since the terminal can be separated just by releasing a locking state between the housing lance and the terminal, it is possible to simply carry out the separating operation without a tool or the like at the time of separating the connector, and thus to improve the separability.

According to the configuration (4), since both sides of the terminal in a thickness direction are pressed and supported by the housing arm, a falling action or a deviation of the terminal is prevented. Accordingly, it is possible to improve the positioning precision of the terminal, and thus to further improve the reliability of the electric connection operation.

Advantageous Effects

According to the invention, in the connector including: a terminal electrically connected to an end of an electric wire; and a connector housing which accommodates the terminal, wherein the terminal is capable of being fastened to an opposite member by means of a fastening member so that the terminal is electrically connected to the opposite member, since the terminal is supported by the housing arm so as to be displaceable, a deformation of the terminal does not occur. In addition, since the accurate positioning operation of the terminal can be carried out by the housing arm, the terminal can reliably contact with the opposite member. As a result, it is possible to provide the connector capable of improving the reliability of the electric connection operation.

BEST MODE FOR CARRYING OUT THE INVENTION

Hereinafter, an exemplary embodiment of the invention will be described in detail with reference to the accompanying drawings.

Figure 1:
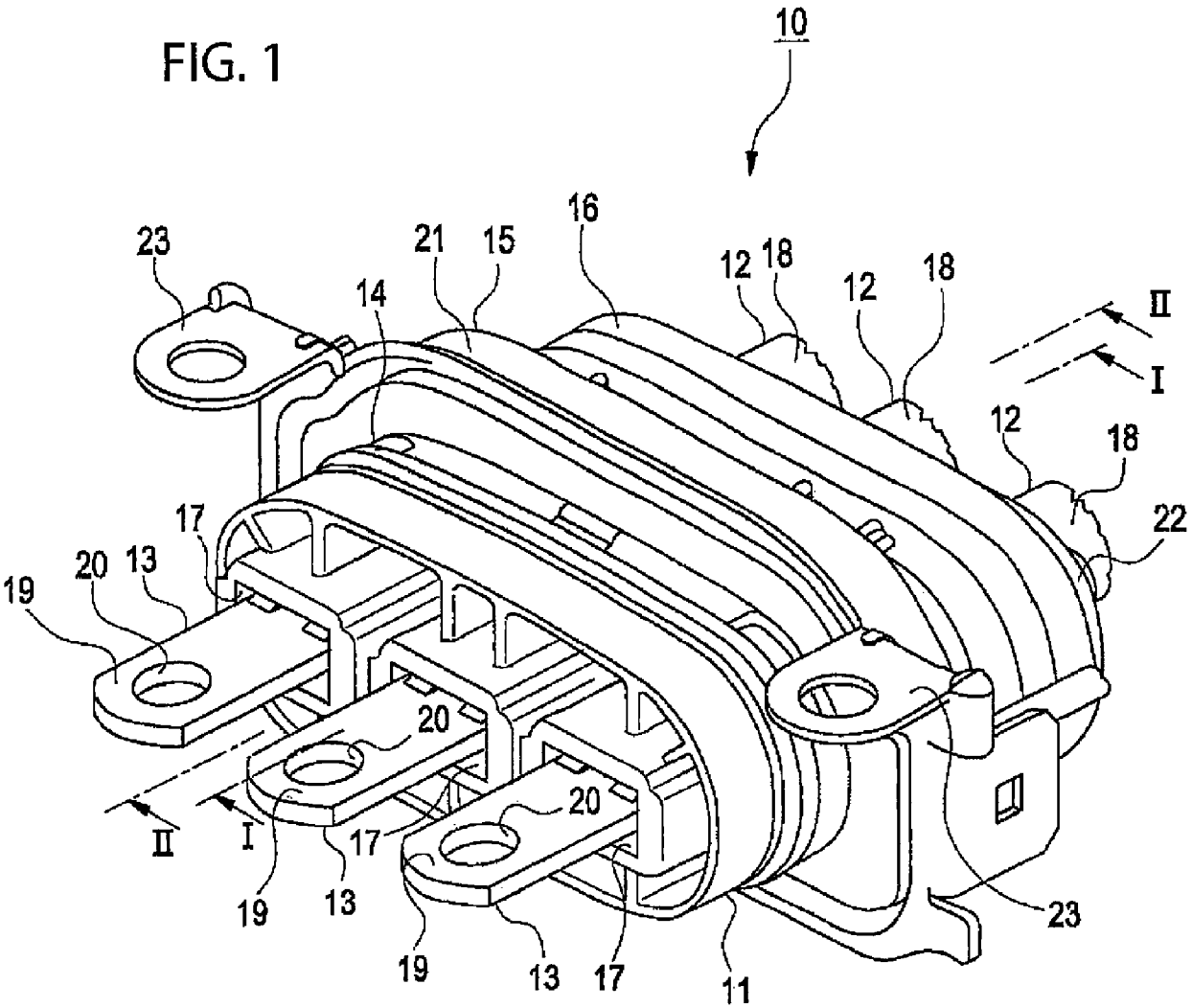
FIG. 1 is an external perspective view showing a connector according to an embodiment of the invention when obliquely viewed from the front side.
Figure 2:
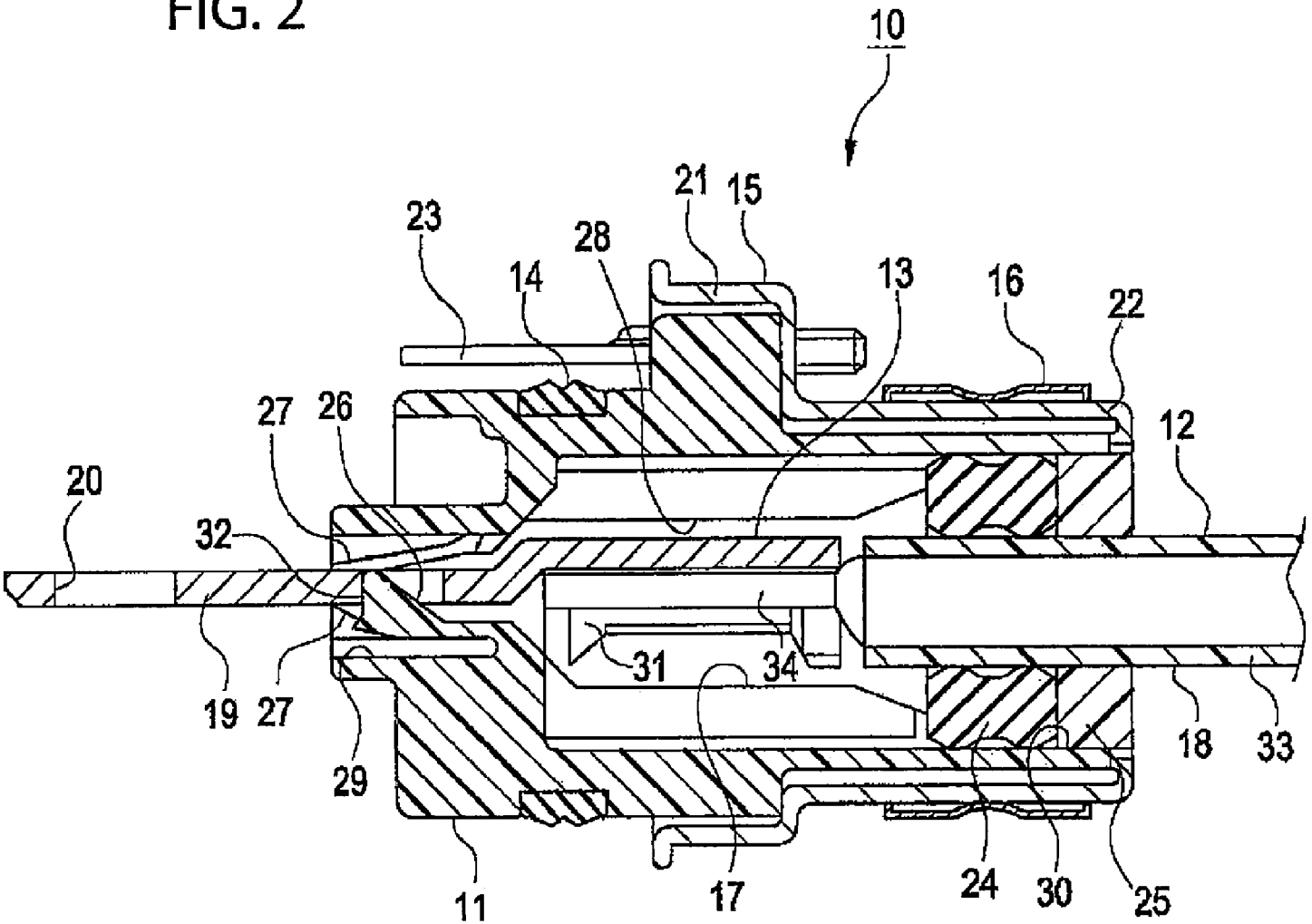
FIG. 2 is a sectional view taken along the line I-I of FIG. 1.
Figure 3:
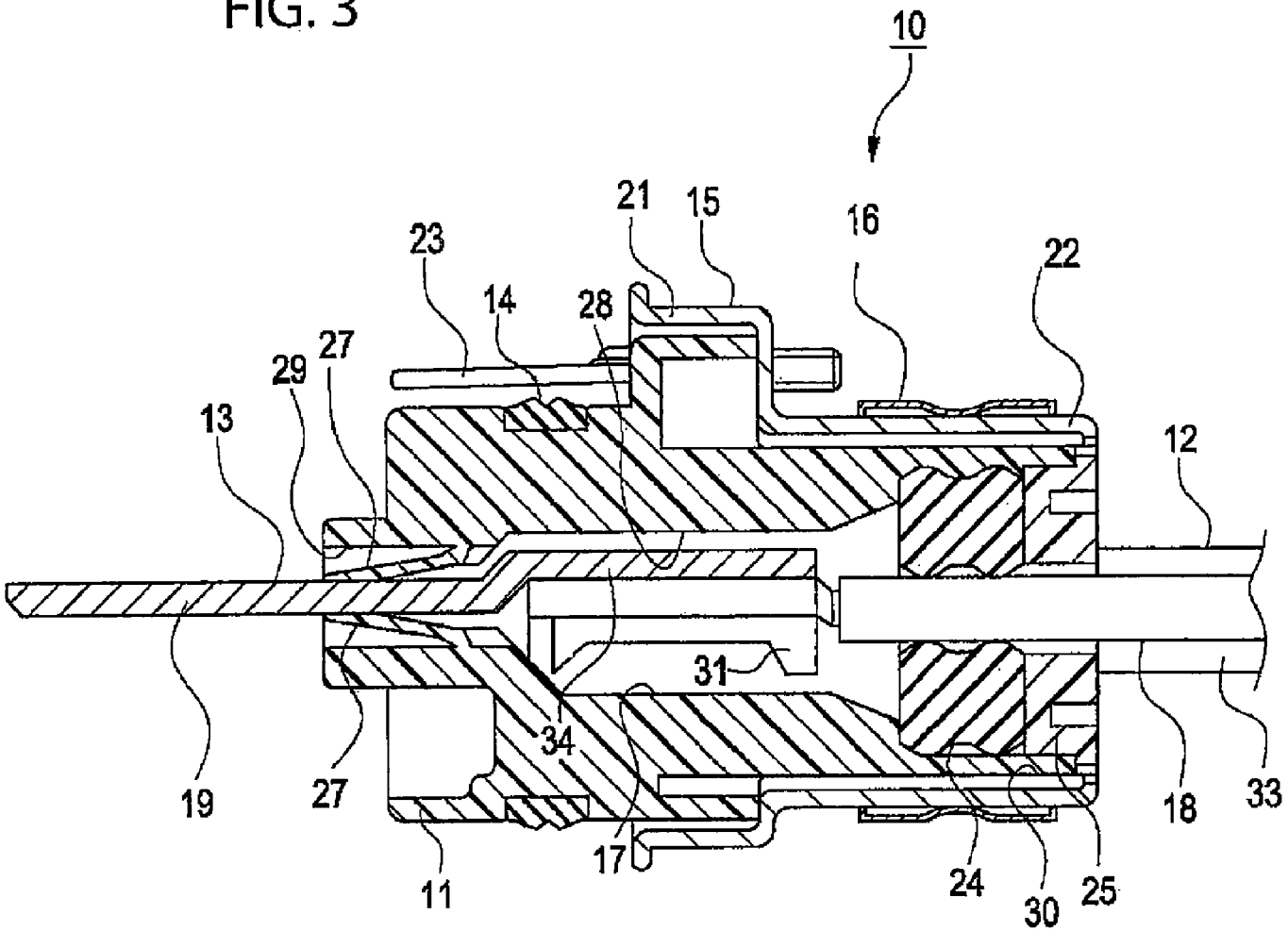
FIG. 3 is a sectional view taken along the line II-II of FIG. 1.
Figure 4:
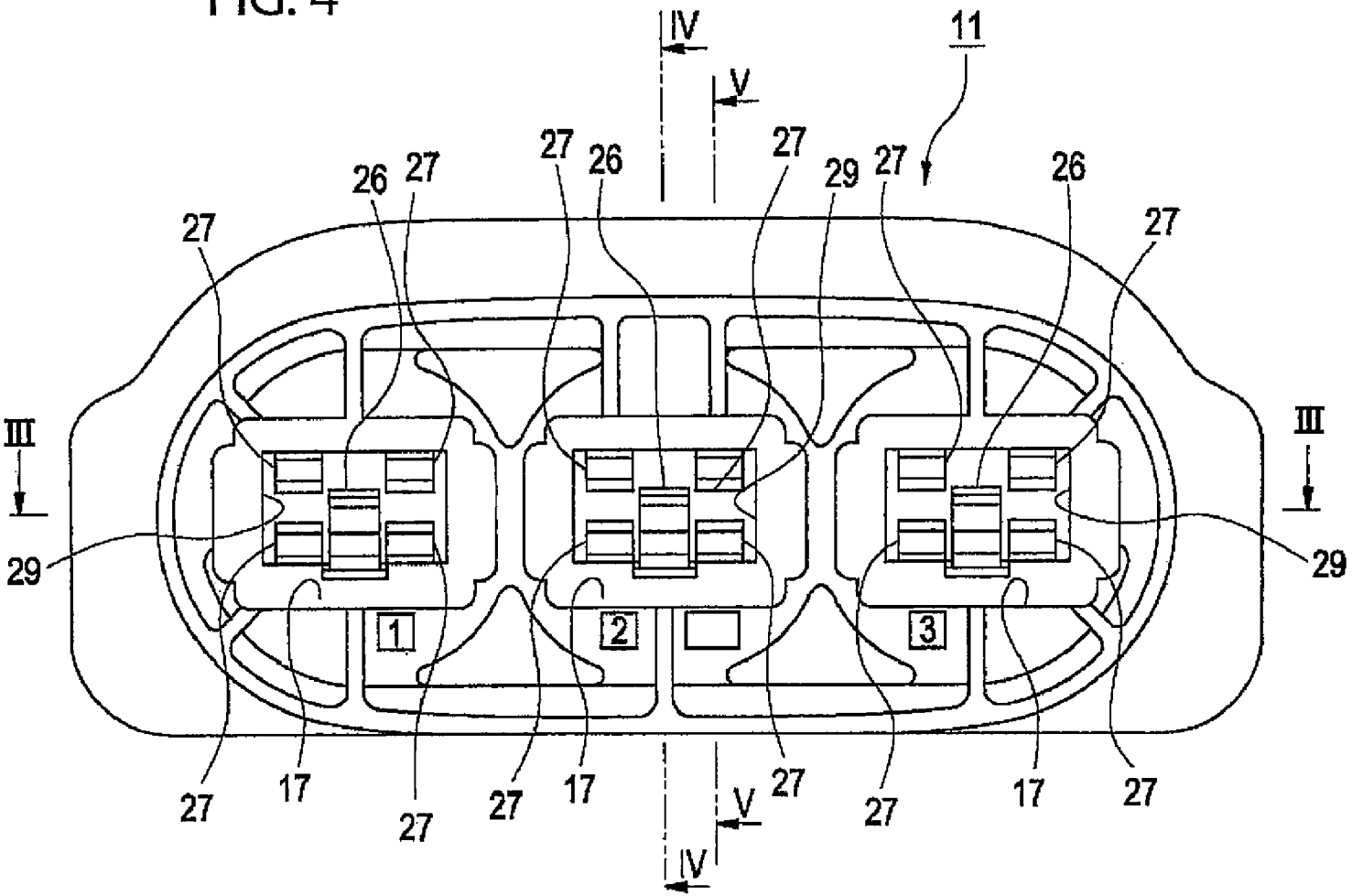
FIG. 4 is a front view showing a single body of a connector housing applied to the connector of FIG. 1.
Figure 5:
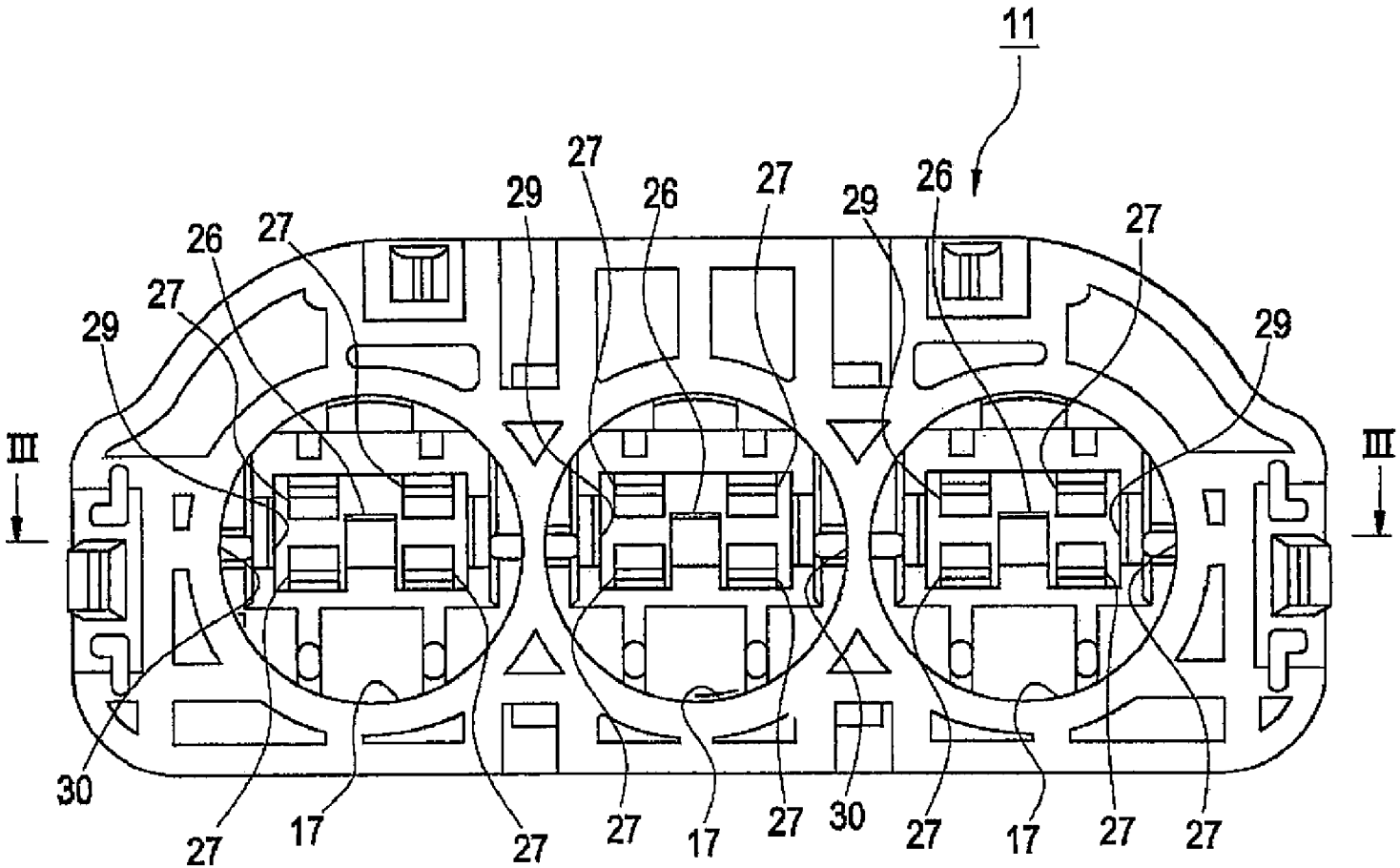
FIG. 5 is a rear view showing the connector housing of FIG. 4.
Figure 6:
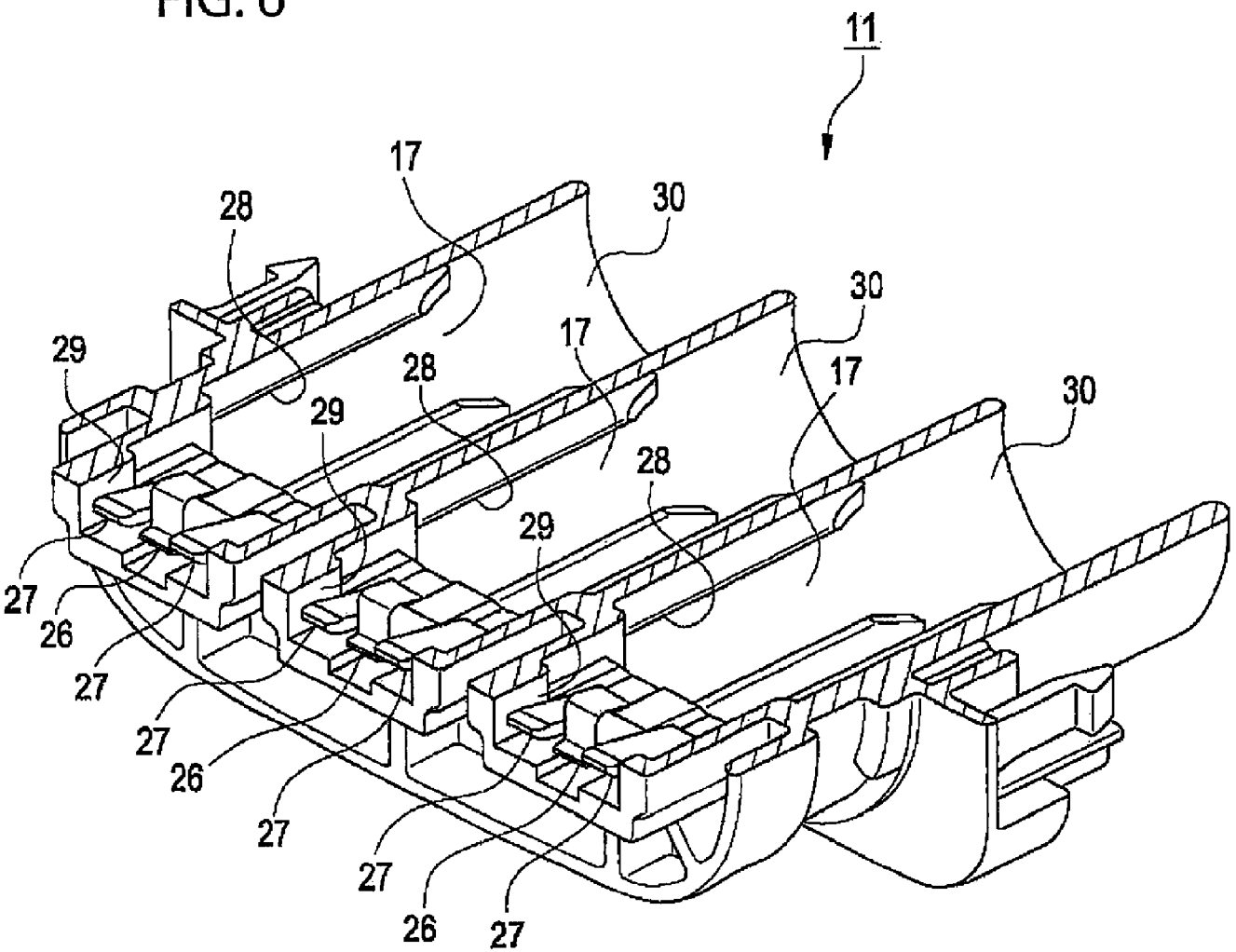
FIG. 6 is a sectional view showing the connector housing of FIG. 4 when taken along the line III-III.

FIGS. 1 to 12 are views showing a connector according to an embodiment of the invention. FIG. 1 is an external perspective view showing the connector according to the embodiment of the invention when obliquely viewed from the front side. FIG. 2 is a sectional view taken along the line I-I of FIG. 1. FIG. 3 is a sectional view taken along the line II-II of FIG. 1. FIG. 4 is a front view showing a single body of a connector housing applied to the connector of FIG. 1. FIG. 5 is a rear view showing the connector housing of FIG. 4. FIG. 6 is a sectional view showing the connector housing of FIG. 4 when taken along the line III-III.

Figure 7:
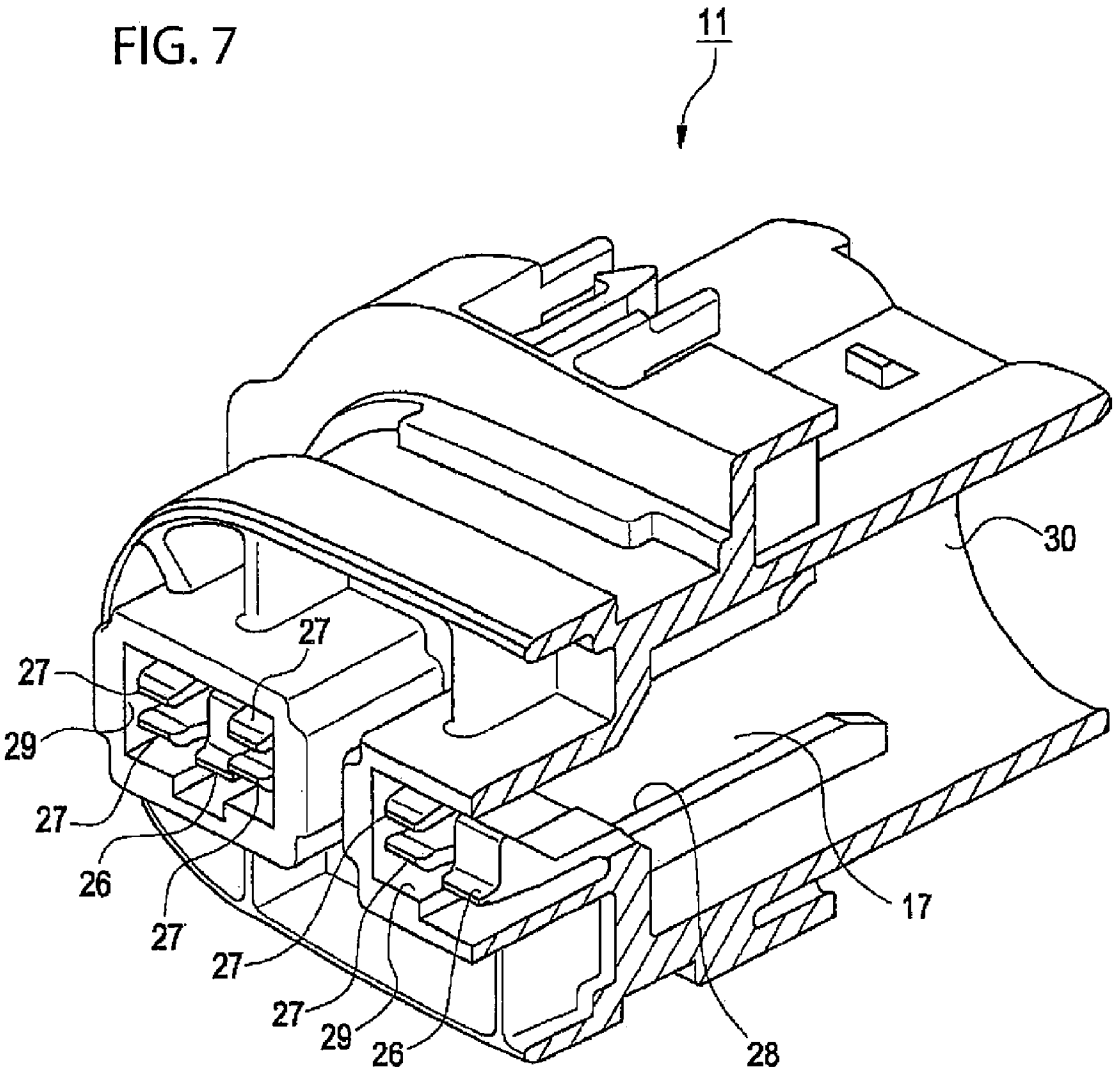
FIG. 7 is a sectional view showing the connector housing of FIG. 4 when taken along the line IV-IV.
Figure 8:
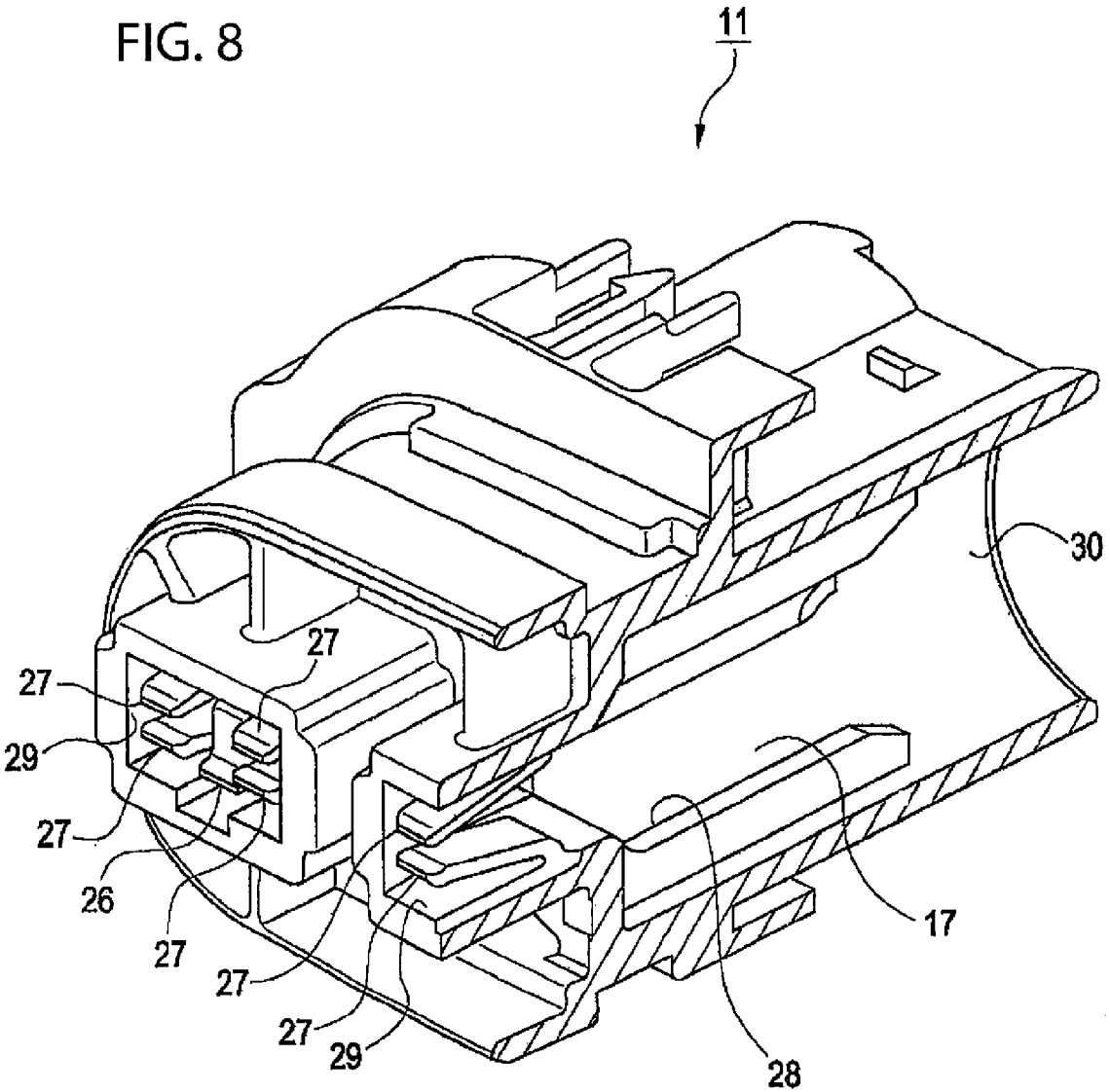
FIG. 8 is a sectional view showing the connector housing of FIG. 4 when taken along the line V-V.
Figure 9:
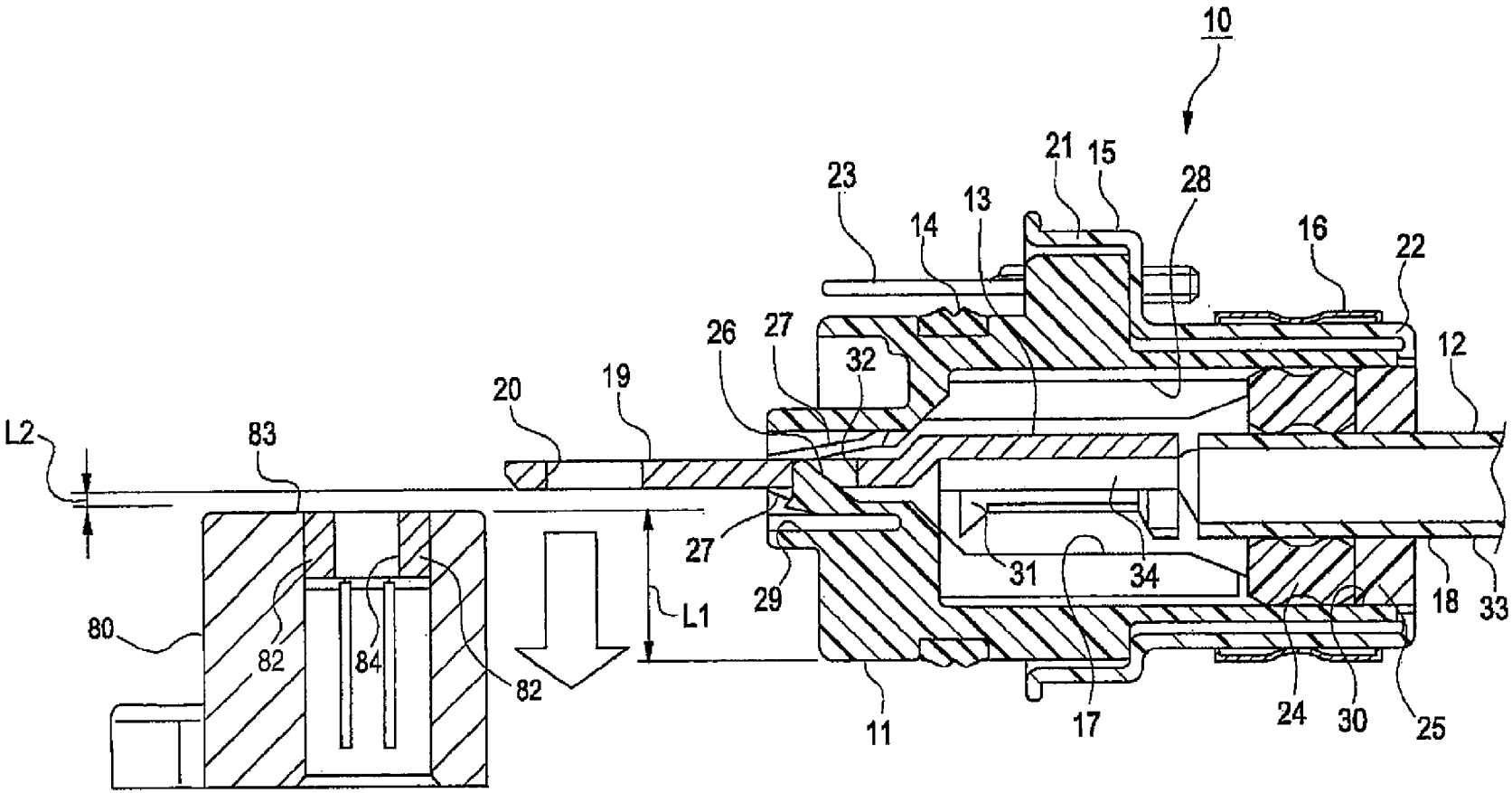
FIG. 9 is a sectional view corresponding to FIG. 2 and showing the state where a terminal is away from an opposite member before the connector of FIG. 1 is assembled in the opposite member.
Figure 10:
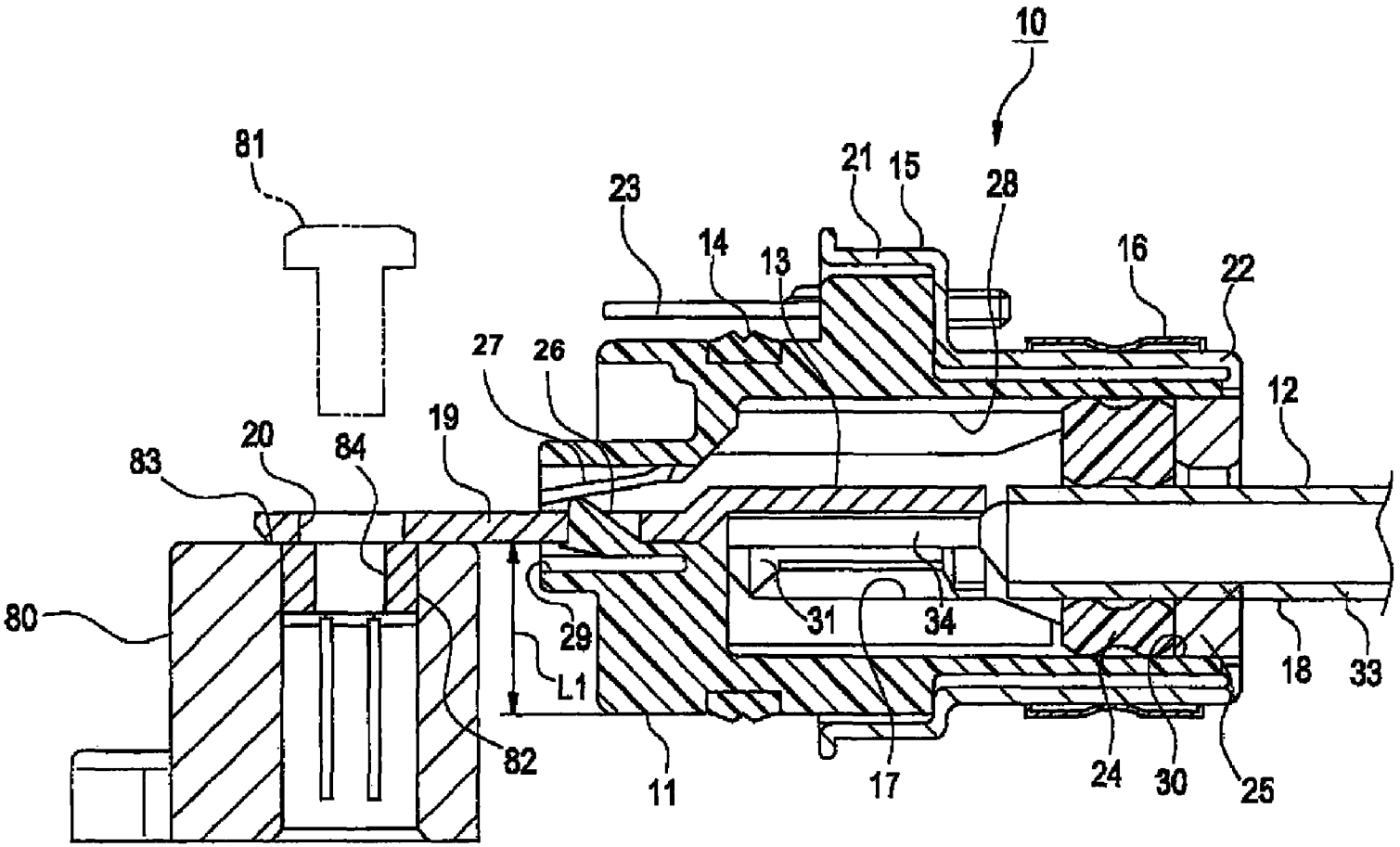
FIG. 10 is a sectional view corresponding to FIG. 2 and showing the state where the terminal is away from the opposite member after the connector of FIG. 1 is assembled in the opposite member.
Figure 11:
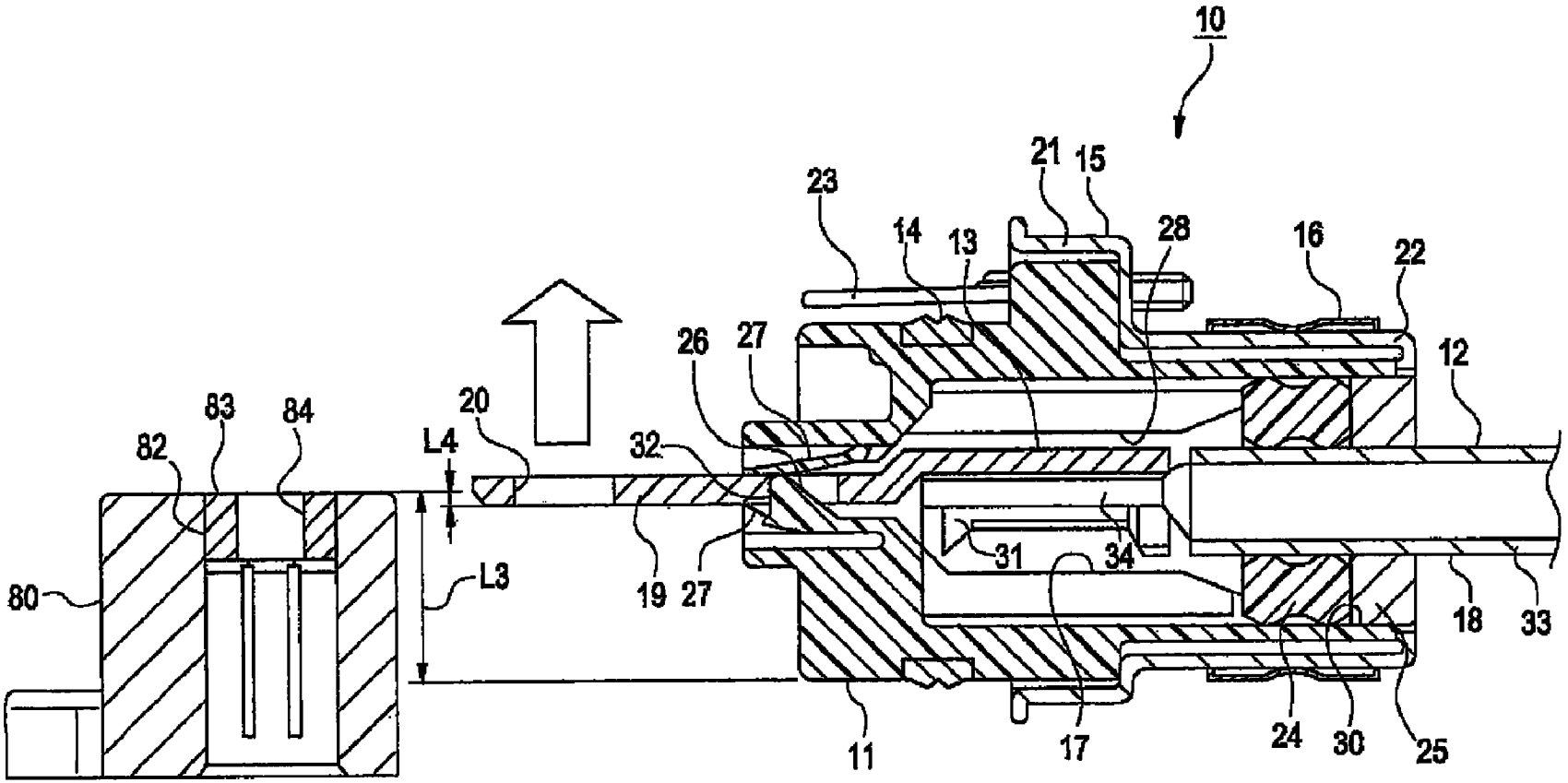
FIG. 11 is a sectional view corresponding to FIG. 2 and showing the state where the terminal wraps the opposite member before the connector of FIG. 1 is assembled in the opposite member.
Figure 12:
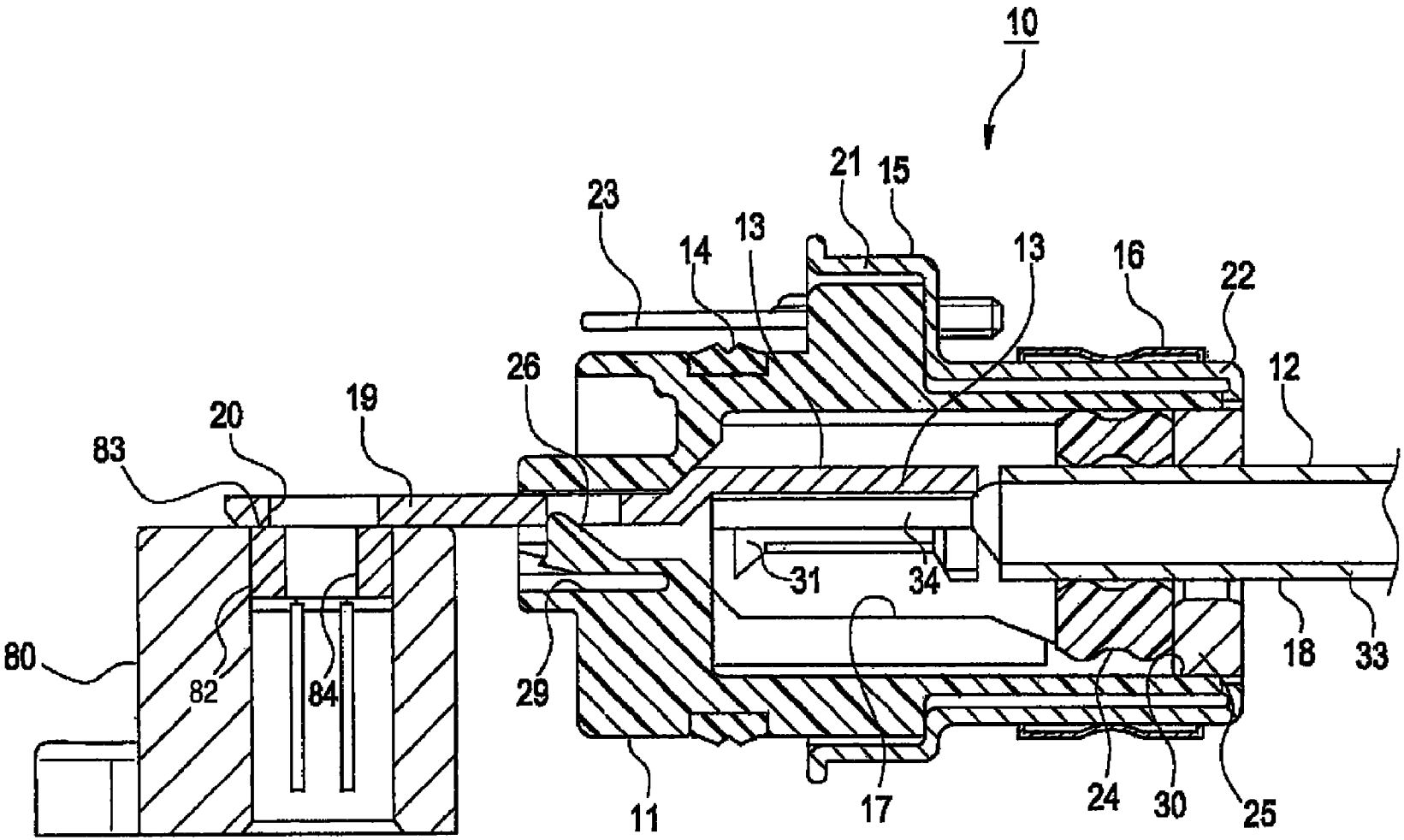
FIG. 12 is a sectional view corresponding to FIG. 2 and showing the state where the terminal wraps the opposite member after the connector of FIG. 1 is assembled in the opposite member.
Figure 13:
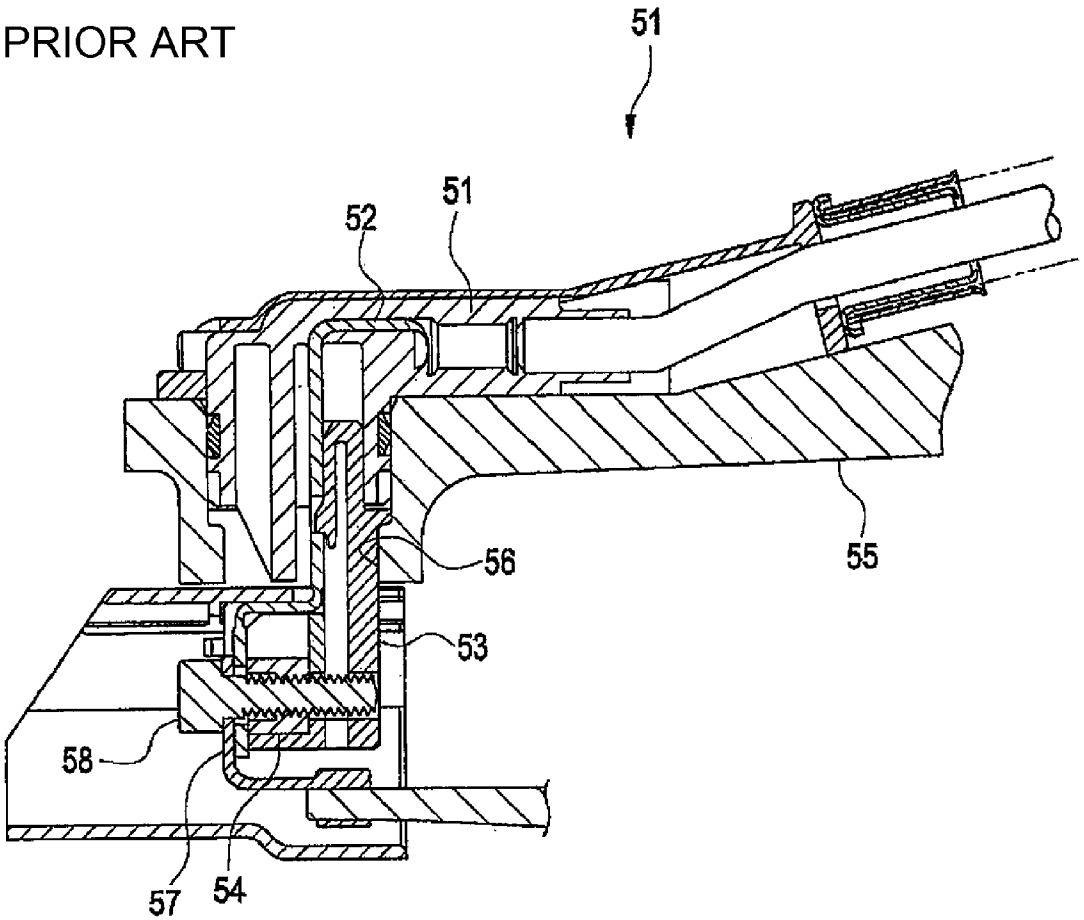
FIG. 13 PRIOR ART
FIG. 13 is a sectional view showing a related connector.

In addition, FIG. 7 is a sectional view showing the connector housing of FIG. 4 when taken along the line IV-IV. FIG. 8 is a sectional view showing the connector housing of FIG. 4 when taken along the line V-V. FIG. 9 is a sectional view corresponding to FIG. 2 and showing the state where a terminal is away from an opposite member before the connector of FIG. 1 is assembled in the opposite member. FIG. 10 is a sectional view corresponding to FIG. 2 and showing the state where the terminal is away from the opposite member after the connector of FIG. 1 is assembled in the opposite member. FIG. 11 is a sectional view corresponding to FIG. 2 and showing the state where the terminal wraps the opposite member before the connector of FIG. 1 is assembled in the opposite member. FIG. 12 is a sectional view corresponding to FIG. 2 and showing the state where the terminal wraps the opposite member after the connector of FIG. 1 is assembled in the opposite member.

As shown in FIG. 1, a connector 10 according to the embodiment of the invention is a bolt fastening connector including a connector housing 1; electric wire attaching terminals 12 which are attached with three terminals 13; a unit packing 14; a shield shell 15; and a shield ring 16.

The connector housing 11 is formed of an insulating resin material so as to have a tube shape, and has therein three terminal cavities 17 which are disposed in parallel.

In the electric wire attaching terminals 12, the terminals 13 are electrically connected to the ends of electric wires 18, respectively, and are accommodated in the terminal cavities 17 of the connector housing 11, respectively. Each terminal 13 has a configuration in which an electric connection portion 19 provided at a position on the front end side is disposed so as to protrude from the front end of the connector housing 11 and a fastening hole 20 is formed in the electric connection portion 19.

The unit packing 14 is formed of, for example, an elastic material such as rubber so as to have an annular shape, and is fitted to the outside at a position close to the front end of the connector housing 11.

The shield shell 15 is formed of a conductive metal material so as to have a tube shape in which a large-diameter-side tube portion 21 and a small-diameter-side tube portion 22 are continuously formed. External fixing flanges 23 are respectively formed in both ends of the large-diameter-side tube portion 21 in a transverse direction. The shield shell 15 is mounted to the outside of the connector housing 11 so as to cover the whole outer periphery of the connector housing 11.

The shield ring 16 is formed of a conductive metal material which is the same as that of the shield shell 15 so as to have a tube shape which has an inner diameter slightly larger than an outer diameter of the small-diameter-side tube portion 22 of the shield shell 15.

After a braided conductor (not shown) is covered on the small-diameter-side tube portion 22 of the shield shell 15 mounted to the outside of the connector housing 11, the shield ring 16 is mounted to the outside of the braided conductor. Subsequently, the braided conductor is electrically connected to the small-diameter-side tube portion 22 of the shield shell 15 by carrying out a caulking operation. Since the braided conductor surrounds the periphery of an axial direction of the electric wire 18 extending backward from the connector housing 11, the braided conductor has a function of preventing disturbance.

As shown in FIG. 2, the connector 10 further includes a rubber lid 24 and a rear holder 25. In addition, the connector 10 includes a housing lance 26 and a housing arm 27 which are provided in the terminal cavity 17.

The terminal cavity 17 of the connector housing 11 has a configuration in which a center terminal cavity 28 disposed at the center portion, a front terminal cavity 29 disposed at the front portion, and a rear terminal cavity 30 disposed at the rear portion communicate with one another.

In addition, the electric wire attaching terminal 12 has a configuration in which a conductor connection portion 31 provided in the rear end of the terminal 13 is disposed inside the center terminal cavity 28 and the electric connection portion 19 provided in the front end of the terminal 13 is disposed inside the front terminal cavity 29. The terminal 13 has a configuration in which an engagement hole 32 is formed at the center position between the electric connection portion 19 and the conductor connection portion 31.

The conductor connection portion 31 is electrically connected to a conductor 34 by caulk-fixing the conductor 34 accommodated in a sheath 33 of the electric wire 18.

The electric wire attaching terminal 12 has a configuration in which the end side of the electric wire 18 is disposed inside the rear terminal cavity 30 and the electric wire 18 is mounted with the rubber lid 24 and the rear holder 25.

The rubber lid 24 is formed of elastic rubber so as to have a tube shape in which the inner diameter side is fitted to the outside of the electric wire 18 of the electric wire attaching terminal 12 and the outer diameter side is fitted to the inside of the rear terminal cavity 30.

The rear holder 25 is formed of a resin material which is the same as that of the connector housing 11 so as to have a tube shape in which the outer diameter side is fitted to the inside of the rear terminal cavity 30 and the electric wire 18 is inserted through the inner diameter side.

Since the rear holder 25 is press-inserted into the rear terminal cavity 30 from the rear side of the connector housing 11, the end surface thereof comes into contact with the end surface of the rubber lid 24.

The housing lance 26 is elastically deformable, and obliquely extends in a forward direction from the lower surface at the center portion of the front terminal cavity 29 of the connector housing 11.

When the electric wire attaching terminal 12 having the terminal 13 formed at the end thereof is inserted from the rear terminal cavity 30 of the connector housing 11, the housing lance 26 is locked to the engagement hole 32 at the center portion of the terminal 13. Accordingly, the housing lance 26 positions the terminal 13 to a predetermined position inside the connector housing 11 in an axial direction of the electric wire attaching terminal 12.

In addition, even when the terminal 13 displaces in a vertical direction of FIG. 2, the vertical direction corresponding to a fastening direction of a bolt 81 serving as a fastening member threaded into a below-described opposite member (terminal block) 80, the housing lance 26 maintains the state where the terminal 13 is locked to the engagement hole 32.

As shown in FIG. 3, the housing arms 27 are elastically deformable, and obliquely extend in a forward direction from the upper surface and the lower surface at the center portion of the front terminal cavity 29 of the connector housing 11, respectively.

The housing arms 27 elastically press the electric connection portion 19 of the terminal 13 in a vertical direction. Accordingly, the terminal 13 is supported so as to be displaceable in a vertical direction of FIG. 3, the vertical direction corresponding to the fastening direction of the bolt 81.

In addition, even when the terminal 13 becomes oblique, since the housing arms 27 elastically press the terminal 13, the posture of the terminal 13 is maintained to be parallel in the inside of the connector housing 11.

Next, a single body structure of the connector housing 11 will be described with reference to FIGS. 4, 5, 6, 7, and 8.

As shown in FIG. 4, the connector housing 11 has a configuration in which each of three front terminal cavities 29 is formed in a rectangular hole shape. In addition, each of three front terminal cavities 29 includes one housing lance 26 and two pairs of housing arms 27 which are four in total.

As shown in FIG. 5, the connector housing 11 has a configuration in which each of three rear terminal cavities 30 is formed in a circular hole shape.

As shown in FIG. 6, the connector housing 11 has a configuration in which the housing lance 26 is disposed at the center portion inside the front terminal cavity 29 and two pairs of housing arms 27 are disposed on both sides of the housing lance 26.

As shown in FIGS. 7 and 8, the connector housing 11 has a configuration in which the electric connection portion 19 of the terminal 13 is sandwiched between two pairs of housing arms 27, disposed on both sides of the housing lance 26, in a vertical direction. Accordingly, since both sides of the terminal 13 in a thickness direction are pressed in a vertical direction, the terminal 13 is supported in a stable manner so that a falling action or a deviation does not occur.

Next, in a procedure in which the connector 10 is assembled in the opposite member 80, the case where the terminal 13 is away from the opposite member 80 will be described with reference to FIGS. 9 and 10.

As shown in FIG. 9, the opposite member 80 is a terminal block which is provided in an electric component such as a motor, and the nut member 82 is fixed thereto as a fastening member. The bolt 81 serving as a fastening member is threaded into the nut member 82.

At this time, the lower end surface of the connector 10 is held at a position, distanced from a fixed surface 83 of the opposite member 80 by a distance L1 in a normal fastening direction of the bolt 81, so as to be movable in parallel. Accordingly, the terminal 13 is distanced by a distance L2 in an opposite fastening direction of the bolt 81, that is, an opposite threading direction.

As shown in FIG. 10, the connector 10 moves in parallel toward the opposite member 80 so that the fastening hole 20 of the terminal 13 is concentric with respect to a female screw hole 84 of the nut member 82, and the terminal 13 is disposed above the fixed surface 83 of the opposite member 80 so as to be distanced by a distance L2 (see FIG. 9).

Subsequently, the bolt 81 is threaded into the female screw hole 84 of the nut member 82 via the fastening hole 20 of the terminal 13.

Accordingly, in accordance with the threading operation of the bolt 81, a stress is applied to the terminal 13 in a downward direction of FIG. 10, the downward direction corresponding to the threading direction of the bolt 81.

However, the terminal 13 is supported by the housing arms 27 so as to be displaceable in a downward direction of FIG. 10. Accordingly, the electric connection portion 19 moves downward with respect to the connector housing 11. Thus, an excessive stress is not applied to the terminal 13. At this time, the housing lance 26 continuously support the terminal 13 together with the housing arms 27 in the state where the locking state between the housing lance 26 and the engagement hole 32 is maintained.

Subsequently, when the bolt 81 is fastened to the nut member 82, the terminal 13 is electrically connected to an internal circuit of the electric component such as a motor via the bolt 81 and the nut member 82.

Next, in a procedure in which the connector 10 is assembled in the opposite member 80, the case where the terminal 13 wraps the opposite member 80 will be described with reference to FIGS. 11 and 12.

As shown in FIG. 11, the lower end surface of the connector 10 is held at a position, distanced from the fixed surface 83 of the opposite member 80 by a distance L3 larger than the distance L1 shown in FIG. 9 in a normal fastening direction of the bolt 81, so as to be movable in parallel. Accordingly, the terminal 13 is distanced from the fixed surface 83 of the opposite member 80 by a distance L4 in a normal fastening direction of the bolt 81, that is, a normal threading direction.

As shown in FIG. 12, the connector 10 moves in parallel toward the opposite member 80 so that the fastening hole 20 of the terminal 13 is concentric with respect to the female screw hole 84 of the nut member 82, and the terminal 13 is lifted upward and moves so that the terminal 13 is disposed on the fixed surface 83 of the opposite member 80, thereby disposing the terminal 13 on the fixed surface 83 of the opposite member 80.

Accordingly, a stress is applied to the terminal 13 in an upward direction of FIG. 12, the upward direction corresponding to the opposite threading direction of the bolt 81.

However, the terminal 13 is supported by the housing arms 27 so as to be displaceable in an upward direction of FIG. 12. Accordingly, the electric connection portion 19 moves upward with respect to the connector housing 11. Thus, it is possible to remove a clattering action of the nut member 82. At this time, the housing lance 26 continuously support the terminal 13 together with the housing arms 27 in the state where the locking state between the housing lance 26 and the engagement hole 32 is maintained.

Subsequently, the bolt 81 is threaded into the female screw hole 84 of the nut member 82 via the fastening hole 20 of the terminal 13.

Subsequently, when the bolt 81 is fastened to the nut member 82, the terminal 13 is electrically connected to an internal circuit of the electric component such as a motor via the bolt 81 and the nut member 82.

As described above, according to the connector 10 of this embodiment, since the terminal 13 is supported by the housing arms 27 so as to be displaceable, a deformation of the terminal 13 does not occur. According to the connector 10, the terminal 13 is pressed by the housing arms 27 so that the posture of the terminal 13 is maintained to be parallel in the inside of the connector housing 11. In addition, at the time when the terminal 13 is electrically connected to the opposite member 80 by means of the bolt 81, since the terminal 13 is elastically supported by the housing arms 26, the terminal 13 displaces in accordance with the position of the opposite member 80, and a clattering action of the terminal 13 with respect to the opposite member 80 is absorbed. Accordingly, since the terminal 13 is positioned by the housing arms 27 without a problem that the opposite member 80 is excessively distanced from the terminal 13 in a fastening direction of the bolt 81 or the opposite member 80 overlaps with the terminal 13, it is possible to prevent a deformation of the terminal 13 and to reliably carry out an electric connection operation to the opposite member 80. As a result, it is possible to improve reliability of the electric connection operation.

In addition, according to the connector 10 of this embodiment, since the housing lance 26 is locked to the engagement hole 32 at the center portion of the terminal 13 for a supporting operation, it is possible to support the terminal 13 in a stable manner.

According to the connector 10 of this embodiment, in addition to the configuration in which the housing arms 27 support the terminal 13 so as to be displaceable in a fastening direction of the bolt 81, the housing lance 26 positions the terminal 13 in an axial direction of the electric wire attaching terminal 12 for a supporting operation. Accordingly, it is possible to position the terminal 13 to a predetermined position inside the connector housing 11. In addition, since the terminal 13 can be separated just by releasing a locking state between the housing lance 26 and the terminal 13, it is possible to simply carry out the separating operation without a tool or the like during the separating operation, and thus to improve the separability.

According to the connector 10 of this embodiment, since both sides of the terminal 13 in a thickness direction are pressed and supported by the housing arms 27, a falling action or a deviation of the terminal 13 is prevented. Accordingly, it is possible to improve the positioning precision of the terminal, and thus to further improve the reliability of the electric connection operation.

The present invention is not limited to the above-described embodiment, but the modification, the improvement, and the like can be arbitrarily made. In addition, the material, the shape, the dimension, the numerical value, the shape, the number, the arrangement position, and the like of each of the components according to the above-described embodiment are not limited, but may be arbitrarily set if the invention can be achieved.

For example, the number of terminal cavities may be one or more instead of three, and may be arbitrarily set in accordance with the number of transmitted signals or circuits. Of course, the number of electric wire attaching terminals is selected in correspondence to the number of terminal cavities.

The present application is based on Japanese Patent Application No. 2008-054523 filed on Mar. 5, 2008, the contents of which are incorporated herein for reference.

INDUSTRIAL APPLICABILITY

The connector is provided which achieves that a deformation of a terminal does not occur and a positioning operation of a terminal can be easily carried out to thereby improve reliability of an electric connection operation to an opposite member.

The invention claimed is:

1. A connector comprising:

a terminal electrically connected to an end of an electric wire; and a connector housing which accommodates the terminal and the electric wire, wherein the terminal is configured to being fastened to an opposite member by means of a fastening member so that the terminal is electrically connected to the opposite member; and wherein the connector housing includes at least one resilient housing arm which supports the terminal so as to be displaceable in a direction in which the fastening member is fastened to the opposite member, the connector housing further includes a housing lance which locks the terminal so as to prevent he terminal from coming off from the connector housing, and the housing lance is different from the at least one housing arm.

2. The connector according to claim 1, wherein the housing lance positions the terminal in a direction in which the terminal extends.

3. The connector according to claim 1, wherein the housing arms elastically press and supports both sides of the terminal in a thickness direction of the terminal.

* * * * *